US005388354A

United States Patent [19]

Marshall et al.

[11] Patent Number: 5,388,354

[45] Date of Patent: Feb. 14, 1995

[54] INDICATORS FOR GARMENT HANGERS

[75] Inventors: David J. Marshall, East Doncaster; Joseph C. Hollis, East Bentleigh, both of Australia

[73] Assignee: Spotless Plastics Pty. Ltd., Moorabbin, Australia

[21] Appl. No.: 176,087

[22] Filed: Dec. 30, 1993

Related U.S. Application Data

[63] Continuation of Ser. No. 985,342, Nov. 30, 1992, abandoned, which is a continuation of Ser. No. 741,462, Sep. 17, 1991, abandoned.

[30] Foreign Application Priority Data

Feb. 8, 1989 [AU] Australia ..... PJ2623

[51] Int. Cl.[6] ..... G09F 3/00

[52] U.S. Cl. ..... 40/322

[58] Field of Search ..... 40/322, 299; 223/85

[56] References Cited

U.S. PATENT DOCUMENTS

| | | | |
|---|---|---|---|
| D. 192,845 | 5/1962 | Cohen | 40/322 X |
| D. 244,197 | 5/1977 | Ostroll | D19/13 |
| D. 264,912 | 6/1982 | Bliss et al. | D6/254 |
| D. 302,214 | 7/1989 | Wilson | D6/318 |
| 282,982 | 3/1986 | Kodet | D6/328 |
| 2,074,841 | 3/1937 | Haimowitz . | |
| 2,099,596 | 11/1937 | Bruening . | |
| 2,288,071 | 6/1942 | Cohen . | |
| 3,024,953 | 3/1962 | O'Keefe | 223/88 |
| 3,535,808 | 10/1970 | Morrish . | |
| 3,949,914 | 4/1976 | Ostroll | 223/85 |
| 4,006,547 | 2/1977 | Samuels et al. | 40/322 |
| 4,045,899 | 9/1977 | Richardson | 40/322 |
| 4,115,940 | 9/1978 | Phillips | 40/322 |
| 4,137,661 | 2/1979 | Johansson | 40/322 |
| 4,322,902 | 4/1982 | Lenthall | 40/322 |
| 4,333,590 | 6/1982 | Princiotta | 223/85 |
| 4,450,639 | 5/1988 | Duester | 40/322 |
| 4,714,156 | 12/1987 | Kolton et al. | 206/296 |
| 4,863,078 | 9/1989 | Benesch | 40/322 X |
| 4,886,195 | 12/1989 | Blanchard | 40/322 X |

FOREIGN PATENT DOCUMENTS

| | | | |
|---|---|---|---|
| 4231878 | 7/1978 | Australia . | |
| 4232078 | 7/1978 | Australia . | |
| 5598880 | 2/1980 | Australia . | |
| 5701180 | 3/1980 | Australia . | |
| 1331383 | 11/1983 | Australia . | |
| 3200884 | 8/1984 | Australia . | |
| 2607784 | 8/1986 | Australia . | |
| 3401816 | 1/1984 | Germany . | |
| 518708 | 5/1972 | Switzerland . | |
| 2010774 | 7/1979 | United Kingdom | 40/322 |

OTHER PUBLICATIONS

"Hangers" Catalog, A&E Products Group, Inc. (p. 10) and letter dated Mar. 8, 1991 by Kenneth L. King, Esq.

*Primary Examiner*—Peter R. Brown
*Assistant Examiner*—Milton Nelson, Jr.
*Attorney, Agent, or Firm*—Scully, Scott, Murphy & Presser

[57] ABSTRACT

An indicator for attachment to the hook of a moulded plastics garment hanger is disclosed. The indicator has a body, moulded from plastics material, with spaced flat sides forming a cavity which is dimensioned to receive a top web of the hook. The body engages the web at the ends of the opening to the cavity to retain the indicator in position of the web. The body also has slots in the sides adapted for engagement by abutments on the web to retain the indicator in position on the hook.

22 Claims, 1 Drawing Sheet

INDICATORS FOR GARMENT HANGERS

This is a continuation of application Ser. No. 985,342, filed on Nov. 30, 1992, now abandoned which is a continuation of application of Ser. No. 741,462, now abandoned, filed on Sep. 17, 1991, corresponding to International Application PCT/AU90/00048 filed on Feb. 8, 1990 and which designated the U.S.

FIELD OF THE INVENTION

This invention relates to indicators for garment hangers of the type which may be used to indicate the size of a garment supported by the hanger and/or the name of the manufacturer or retailer.

BACKGROUND OF THE INVENTION

The provision of a readily visible size indicator on a garment hanger is now accepted by retailers as a desirable addition to a garment hanger. The most widely accepted indicators have been manufacturered by the applicant under Australian Patent Nos. 509042 (AU-B 42320/78) and 522614 (AU-B 55988/80). While the indicator disclosed in Patent No. 509042 in particular has been well received by retailers, the desire of some retailers to reduce to a minimum the costs of hangers and indicators has meant that other manufacturers have developed less aesthetically pleasing alternatives to the indicator of this patent. In addition, differences in attitude, particularly in overseas markets, have indicated that the "cap" indicator of Patent No. 509042 may be regarded by some as being too bulky and dominant in the overall view of the hanger and the garments supported thereon. Furthermore, since the hook of the hanger must be specially formed to accept this indicator, its use without the indicator may be regarded by some as aesthetically or commercially unacceptable.

SUMMARY OF THE INVENTION AND OBJECT

It is therefore an object of the present invention to provide a less costly and less obtrusive alternative to the cap indicator described in the above patent.

The invention therefore provides an indicator suitable for attachment to the hook of a moulded plastics garment hanger, said indicator comprising a body adapted to display indicia and comprising side walls, end walls and a top wall dimensioned to form a body having a low generally rectangular profile and defining a downwardly opening cavity shaped and dimensioned to receive a narrow upwardly projecting web formed on a hook of a moulded plastics garment hanger, said body having regions between at least said side walls and said top wall which are smoothly rounded while the lowermost edges of at least said side walls are substantially non-rounded to define relatively sharp edges at said lowermost edges, said end walls being spaced to engage in use spaced points on said web such that said indicator is in use stably supported on said web, said smoothly rounded portions and said sharp edges facilitating sorting of said indicators into a preferred orientation. In a preferred form, the cavity is formed with a centrally positioned means dimensioned and positioned to receive an abutment means formed on the upwardly projecting web of the hook of the hanger. In one form, at least one side of the body of the indicator defining the cavity is formed with an opening adapted to receive said abutment. In a particularly preferred form, each side of the body has an opening adapted to receive an abutment formed on either side of the web of the hanger hook.

The invention also provides in combination, an indicator suitable for attachment to the hook of a moulded plastics garment hanger, said indicator comprising a body adapted to display indicia and comprising side walls, end walls and a top wall dimensioned to form a body having a low generally rectangular profile and defining a downwardly opening cavity shaped and dimensioned to receive a narrow upwardly projecting web formed on a hook of a moulded plastics garment hanger, said body having regions between at least said side walls and said top wall which are smoothly rounded while the lowermost edges of at least said side walls are substantially non-rounded to define relatively sharp edges at said lowermost edges, said end walls being spaced to engage in use spaced points on said web such that said indicator is in use stably supported on said web, said smoothly rounded portions and said sharp edges facilitating sorting of said indicators into a preferred orientation.

BRIEF DESCRIPTION OF THE DRAWINGS

One presently preferred form of the invention will now be described with reference to the accompanying drawings in which.

DESCRIPTION OF THE PREFERRED EMBODIMENT

Figure 3:
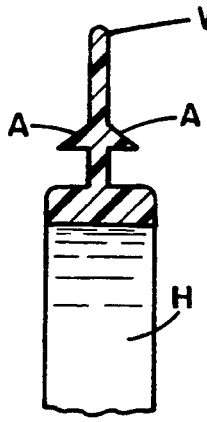
FIG. 3 is a sectional end elevation of the indicator taken along the line 3—3 in FIG. 2 but with the hook removed from the indicator.
Figure 4:
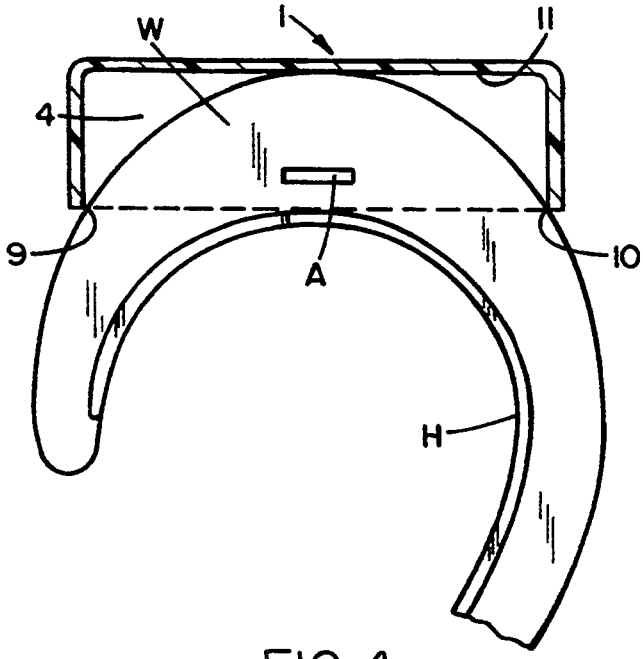
FIG. 4 is a front elevation of the indicator and the hanger hook.

Referring to the drawings, the indicator embodying the invention will be seen to comprise a body 1 moulded from suitable plastics material having spaced flat sides 2 and 3 defining therebetween a cavity 4 dimensioned to receive a top web W of the hook H of a garment hanger, as shown in FIGS. 3 and 4 of the drawings. The sides 2 and 3 are formed with generally rectangular slots 5 and 6 centrally located adjacent the lower edges of the sides 2 and 3, and which are dimensioned and positioned to receive abutments A formed on either side of the web W of the hook H of the hanger to lock the indicator in position on the hook H. The entry of the abutments A into the slots 5 and 6 is achieved by the resilience of the plastics moulding forming the body 1.

Each side 2 and 3 of the indicator 1 is formed with indicia 7, in the present embodiment, a sizing number such as 12. In the present case, the indicia 7 is formed by moulded depressions in the sides 2 and 3, although the indicia may equally well be formed by moulded raised portions or by adhesive labels applied to the sides 2 and 3. If desired, styling grooves such as 8 may also be formed in or on the surface of the sides 2 and 3.

Figure 1:
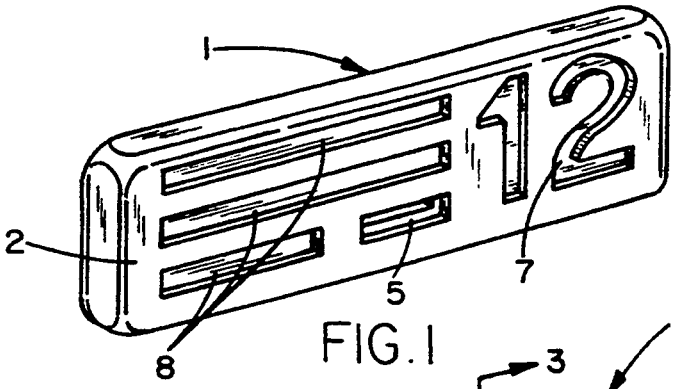
FIG. 1 is a perspective view of an indicator embodying the invention.
Figure 2:
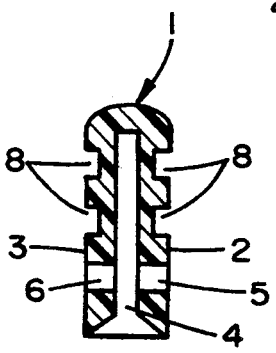
FIG. 2 is a perspective view of the indicator of FIG. 1 fitted to the hook of a hanger.
Figure 2:
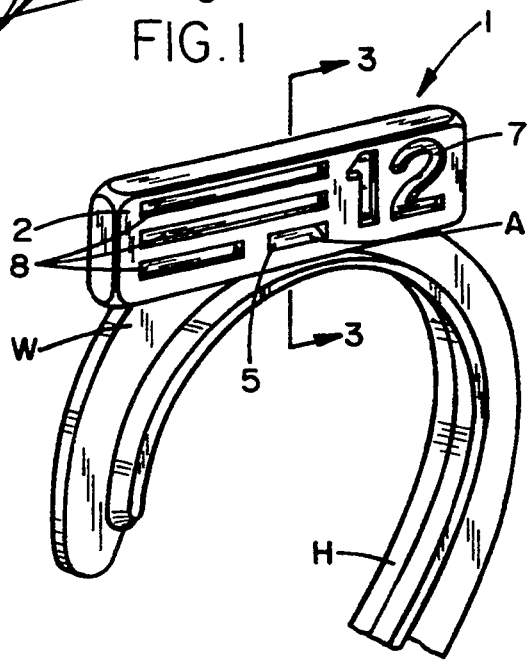

It will be appreciated from FIGS. 2 and 4 of the drawings that the width of the indicator body 1 is approximately the same as the width of the hook H of the hanger, and the indicator has a relatively low narrow rectangular profile, both of which features contribute to the indicator being less obtrusive than indicators of the type described in our Patent 509042. Of course, shapes other than rectangular may be adopted, but it is considered desirable that the width of the indicator should not materially exceed the width of the hook of the hanger so that the indicator is less obtrusive in use.

The indicator body is also formed with smoothly rounded edges, particularly at the uppermost edges of the body, while the lowermost edges of the sides of the body are not rounded, so as to present sharp edges, as shown in FIG. 3. This feature allows the indicators to be sorted with the cavity directed downwardly by running the indicators along a narrow edge in the sorting machine (not shown) whereby engagement between the rounded edges and the narrow edge cause an indicator engaging the edge in this manner to topple over and rest on the sharp edges so that its cavity is directed downwardly. If the sharp edges engage the narrow sorting edge, they will not cause the indicator to topple.

The web W formed on the hook of the hanger H is shaped to provide engagement points between the ends 9 and 10 of the opening to the cavity 4 and the top 11 of the cavity 4 when the indicator is fitted to the web W to limit movement of the indicator on the hook H. By the same token, the shape of the web W is not significantly different from a "normal" shape so the hanger can be used with or without the indicator.

While the web shape shown in FIG. 4 is preferred, for stability, a more standard web shape will give acceptable results since the ends 9 and 10 of the opening to the cavity 4 of the indicator will still engage spaced edge portions of the web W to limit the amount of movement of the indicator even though the top of the web W does not contact the top 11 of the cavity 4. In either event, the web is significantly less obtrusive than the modified hook shape required in the case of the indicator of Patent No. 509042.

Of course, the web may be moulded with an upwardly projecting generally rectangular portion (not shown) which substantially fills the cavity 4 to inhibit any significant movement of the indicator on the web W of the hook H. Such an arrangement has the advantage of providing a rectangular surface on the hook for labels when the indicator is not used.

Alternatively, the cavity 4 may be shaped to correspond to the shape of the web W, although the net benefit of such an arrangement would not appear to outweigh the extra amount of plastics required for such a moulding.

It will be appreciated from the above description that the indicator embodying the invention provides an aesthetically acceptable alternative to the indicator disclosed in Patent No. 509042 with only a minimal modification being required to the shape of the hook of the hanger to which the indicator is to be applied. The indicator presents a narrow profile which does not excessively modify the shape of the uppermost end of the hook of the hanger, while the hook itself may be used without the indicator since it is not significantly different in shape to other hooks. The indicators embodying the invention also lend themselves to automated application techniques which are assisted by the rounded upper edges of the indicator, as described in greater detail above.

We claim:

1. A plastic indicator suitable for attachment to a hook of a molded plastic garment hanger wherein the hook has an upwardly projecting web, said indicator comprising:

a body adapted to display indicia, said body comprising side walls, end walls and a top wall, dimensioned to form said body defining a downwardly opening cavity, said downwardly opening cavity shaped and dimensioned to receive said upwardly projecting web formed on the hook of said molded plastic garment hanger, said cavity of said body being located between at least said side walls and said top wall, said side walls extending from a smoothly rounded portion of said top wall and ending with a relatively sharp edge as defined by a substantially non-rounded lower most edge of at least each said side wall, said end walls being spaced to engage in use spaced points on said web such that said indicator is in use stably supported on said web, at least one of said side walls defining at least one aperture which extends completely through said side wall, said side wall completely surrounding said aperture, said aperture being adapted to interlock with corresponding means on the upwardly projecting web of the hook, said smoothly rounded portion and said sharp edges facilitating sorting of said indicators into a preferred orientation.

2. The indicator as claimed in claim 1, wherein said corresponding means are abutments on the upwardly projecting web of the hook.

3. The indicator as claimed in claim 1, wherein said lower most edge of each side wall is angled inwardly to facilitate entry of said web into said cavity.

4. The indicator as claimed in claim 1, wherein said side walls, end walls and top wall of said body are dimensioned to form a rectangular profile.

5. The indicator as claimed in claim 4, wherein said rectangular profile has a width less than a width of said hook of said hanger and a height of about one-third of the width of said indicator.

6. A plastic indicator suitable for attachment to a hook of a molded plastic garment hanger wherein the hook has an upwardly projecting web, said indicator comprising:

a body adapted to display indicia, said body comprising side walls and end walls dimensioned to form a rectangular profile, said body defining a cavity shaped and dimensioned to receive said upwardly projecting web formed on the hook of said molded plastic garment hanger, said cavity of said body being located between at least said side walls and said end walls, said side walls having a substantially straight lower most edge, said end walls being spaced to engage in use spaced points on said web such that said indicator is in use stably supported on said web, each of said side walls defining at least one aperture which extends completely through said side wall, said side wall completely surrounding said aperture, said apertures being adapted to interlock with corresponding means on the upwardly projecting web of the hook.

7. A plastic molded garment hanger having an indicator for displaying at least one characteristic of a garment hanging therefrom, said garment hanger comprising:

a hook adapted to engage a rod or other supporting means, said hook having an upwardly projecting web extending from said hook for receiving said indicator, said web projecting above a top contour of the hook;

an interlocking engagement means defined on said upwardly projecting web; and said indicator comprising a body adapted to display indicia, said body comprising side walls, end walls and a top wall, said body having a cavity formed therein for receiving said upwardly projecting web therewithin, said indicator defining at least one aperture in at least one of said side walls which receives said interlocking engagement means when said indicator body is attached to said hanger, said side wall completely surrounding said aperture whereby said indicator is supported on said web in a stable manner.

8. The hanger as claimed in claim 7, wherein said indicator body has a thickness which does not substantially exceed a thickness of the hook of the hanger at an upper end of said hook.

9. The hanger as claimed in claim 7, wherein said upwardly projecting web is molded perpendicularly to an arcuate flange which defines an underside of said hook.

10. The hanger as claimed in claim 7, wherein a smoothly curved upper edge of the web extends upwardly and inwardly to engage the cavity within the body in an interlocking manner; said web cooperatinq with said cavity and said interlocking engaging means cooperating with said aperture to secure said indicator in a fixed relationship to said hanger.

11. The hanger as claimed in claim 7, wherein said indicator has rounded top edges.

12. The hanger as claimed in claim 7, wherein said body is dimensioned to form a rectangular profile.

13. The indicator as claimed in claim 7, wherein each of said side walls extends from a smoothly rounded portion of said top wall and ends with a relatively sharp edge as defined by a substantially non-rounded lower most edge of at least each said side wall and said lower most edge of each said side wall is angled inwardly to facilitate entry of said web into said cavity.

14. The hanger as claimed in claim 7, wherein said interlocking engagement means is an abutment defined on at least one side of said upwardly projecting web, said abutment cooperating with said at least one aperture in one of said side walls.

15. A plastic indicator suitable for attachment to a hook of a molded plastic garment hanger, said indicator comprising:

a body adapted to display indicia, said body comprising side walls, end walls and a top wall, dimensioned to form said body defining a downwardly opening cavity, said downwardly opening cavity shaped and dimensioned to receive a narrow upwardly projecting web formed on the hook of said molded plastic garment hanger, said cavity of said body being located between at least said side walls and said top wall, said side walls extending from a smoothly rounded portion of said top wall and ending with a relatively sharp edge as defined by a substantially non-rounded lower most edge of at least each said side wall, at least one of said side walls defining at least one aperture which extends completely through said at least one said side wall, said side wall completely surrounding said aperture, said lower most edge of each side wall being angled inwardly to facilitate entry of said web into said cavity, said end walls being spaced to engage in use spaced points on said web such that said indicator is in use stably supported on said web, said smoothly rounded portion and said sharp edges facilitating sorting of said indicator into a preferred orientation.

16. The indicator as claimed in claim 15, wherein said aperture is adapted to interlock with corresponding means on the upwardly projecting web of the hook.

17. The indicator as claimed in claim 16, wherein said corresponding means is at least one abutment on each side of the upwardly projecting web of the hook.

18. The indicator as claimed in claim 16, wherein the corresponding means is an abutment defined on at least one side of the upwardly projecting web of the hook.

19. A plastic indicator suitable for attachment to a hook of a molded plastic garment hanger wherein the hook has an upwardly projecting web, said indicator comprising:

a body adapted to display indicia, said body comprising at least two side walls and having a cavity shaped and dimensioned to receive said upwardly projecting web formed on the hook of said molded plastic garment hanger, wherein at least one side wall defines at least one aperture which extends completely through said at least one side wall, said at least one side wall completely surrounding said aperture, said aperture being adapted to interlock with corresponding means on said upwardly projecting web of the hook, said cavity being shaped to provide spaced engagement points adapted to receive at least one spaced portion on an edge of said web such that said indicator is in use stably supported on the web.

20. The indicator as claimed in claim 19, wherein the corresponding means is an abutment defined on at least one side of the upwardly projecting web of the hook.

21. The indicator as claimed in claim 19, wherein said side walls each define an aperture extending completely through said side wall and further wherein the corresponding means is an abutment defined on each side of the upwardly projecting web of the hook.

22. The indicator as claimed in claim 19, wherein said side walls are dimensioned to form a rectangular profile, each of said side walls having a substantially straight lower most edge.

* * * * *

UNITED STATES PATENT AND TRADEMARK OFFICE

CERTIFICATE OF CORRECTION

PATENT NO. : 5,388,354

DATED : February 14, 1995

INVENTOR(S) : David J. Marshall, et al.

It is certified that error appears in the above-indentified patent and that said Letters Patent is hereby corrected as shown below:

On the Title Page, item [56], Column 2, line 5: "Benesch" should read --Bengsch--

Column 5, line 25, Claim 10: "cooperatinq" should read --cooperating--

Signed and Sealed this

Twenty-second Day of October, 1996

Bruce Lehman

*Attest:*

BRUCE LEHMAN

*Attesting Officer*

*Commissioner of Patents and Trademarks*